US005649818A

United States Patent [19]

Day

[11] Patent Number: 5,649,818

[45] Date of Patent: Jul. 22, 1997

[54] GAS OVEN BURNER CONTROL METHOD AND APPARATUS

[75] Inventor: Joseph M. Day, Saqinaw, Mich.

[73] Assignee: Banner Engineering & Sales, Inc., Saginaw, Mich.

[21] Appl. No.: 610,492

[22] Filed: Mar. 4, 1996

[51] Int. Cl.[6] ..... F23N 5/20

[52] U.S. Cl. ..... 431/6; 431/89

[58] Field of Search ..... 431/6, 89, 18; 126/116 A

[56] References Cited

U.S. PATENT DOCUMENTS

| | | |
|---|---|---|
| 3,830,619 | 8/1974 | Cade . |
| 4,087,045 | 5/1978 | Matthews . |
| 4,111,640 | 9/1978 | Scott . |
| 4,116,613 | 9/1978 | Matthews . |
| 4,243,373 | 1/1981 | Fernstrom et al. . |
| 4,858,885 | 8/1989 | Kidder et al. . |
| 4,915,613 | 4/1990 | Landis et al. . |
| 4,955,806 | 9/1990 | Grunden et al. . |
| 5,186,386 | 2/1993 | Lynch . |
| 5,456,597 | 10/1995 | Lazar et al. . |

OTHER PUBLICATIONS

Tradeline pp. 611, 612, 633 (date unknown).
Joseph M. Day Co. Drawing No. 82–0914–3 Sep. 14, 1982.
Honeywell, Inc. Form No. 60–2320–8, Apr. 1994, 8 pages.

*Primary Examiner*—Carroll B. Dority
*Attorney, Agent, or Firm*—Learman & McCulloch

[57] ABSTRACT

A method and apparatus for relighting a gas oven following interruption in the operation thereof due to a temporary failure or reduction in the energy level of a source of electric energy comprises instantaneously disconnecting the delivery of pressurized gas to the oven in response to a reduction in the level of the electric energy, slowly reducing the pressure of gas in the delivery system, monitoring the pressure of the gas, and restoring the delivery of fuel to the oven only if the energy supply is restored to a proper level within a short period of time and prior to a predetermined reduction of the gas pressure.

23 Claims, 3 Drawing Sheets

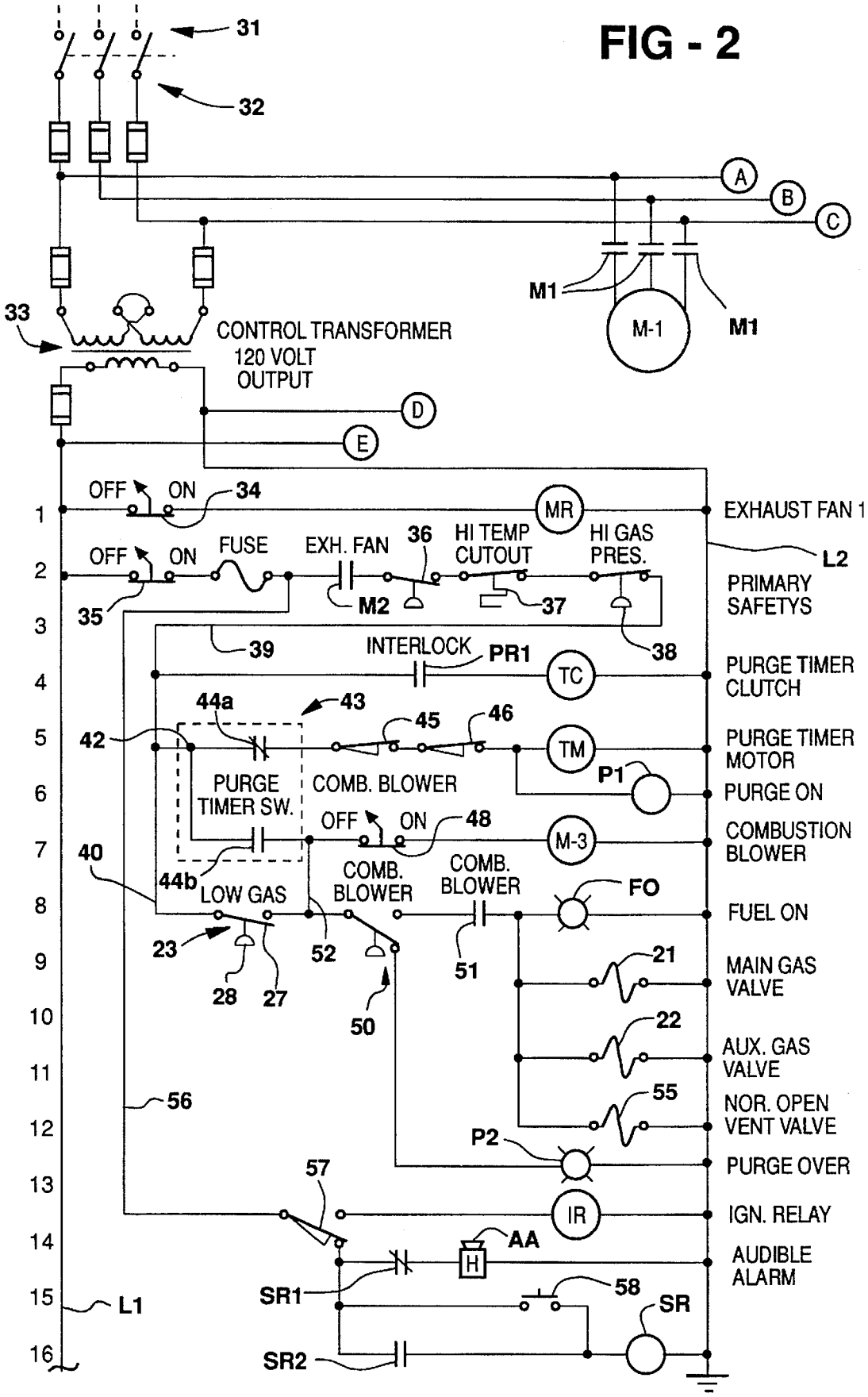
FIG - 2
31
32
A
B
C
M1
M-1
M1
33
CONTROL TRANSFORMER
120 VOLT
OUTPUT
D
E
OFF
ON
34
MR
EXHAUST FAN 1
OFF
ON
FUSE
EXH. FAN
36
HI TEMP
CUTOUT
HI GAS
PRES.
L2
PRIMARY
SAFETYS
35
M2
37
38
39
INTERLOCK
PR1
TC
PURGE TIMER
CLUTCH
44a
43
45
46
42
TM
PURGE TIMER
MOTOR
PURGE
TIMER SW.
COMB. BLOWER
P1
PURGE ON
OFF
ON
48
M-3
COMBUSTION
BLOWER
40
44b
LOW GAS
COMB.
BLOWER
COMB.
BLOWER
FO
FUEL ON
23
52
51
21
MAIN GAS
VALVE
28
27
50
22
AUX. GAS
VALVE
56
55
NOR. OPEN
VENT VALVE
P2
PURGE OVER
57
IR
IGN. RELAY
AA
H
AUDIBLE
ALARM
SR1
58
SR
L1
SR2
1
2
3
4
5
6
7
8
9
10
11
12
13
14
15
16

A
B
C
IR1
IR2
63
D
E
64
TRANSFORMER
120 / 24 VAC
L4
17
L3
18
60
ZONE
SWITCH
ON
OFF
19
20
65
PR
21
SR3
67
G
22
23
F
H
24
66
73
25

GAS OVEN BURNER CONTROL METHOD AND APPARATUS

This invention relates to a method and apparatus for controlling the operation of the fuel burners of a gas oven such as that employed in a commercial bakery, and more particularly to a method and apparatus which disables the supply of gas to the oven burners instantly in the event of termination or reduction in the level of electric power or energy below a predetermined threshold, but which enables the resupply of gas to the oven in the event the power interruption is of relatively short duration and without having to go through a time consuming relighting procedure.

BACKGROUND OF THE INVENTION

Virtually all commercial bakery ovens utilize combustible gas and electrically operated controls for enabling and disabling the flow of gas to each oven. It is fairly common for electrical energy interruptions and reductions, referred to as brownouts, to occur. Virtually all commercial baking ovens include controls responsive to energy interruptions and brownouts for instantly disabling the supply of fuel to each oven, thereby avoiding the delivery to and accumulation of unburned combustible fuel in a hot oven.

Following termination of the flow of fuel to the oven, virtually all of the commercial oven installations require the performance of a relighting procedure which involves, in most cases, purging of the oven, opening dampers and doors, starting fans and blowers, acknowledging alarms, cycling switches, and waiting for the purge to be completed before the oven can be relighted. Should the energy failure or brownout occur during a baking cycle, the baking is terminated until such time as the oven can be relighted.

The relighting process often requires a significant period of time, such as twenty minutes or more. The product that is in the oven when the baking cycle is interrupted thus becomes burned or under-baked and is known as a cripple. If the cripple can be sold at all, it is sold at a price considerably under that at which a first quality product is sold. Often, however, the entire content of an oven must be scrapped. The cost of a power failure or reduction, therefore, even for an extremely short period of time, can lead to a loss in excess of several thousand dollars.

The problems associated with the temporary shutdown and relighting of an oven are well known and many attempts over the years have been made to solve them. For example, it has been proposed to utilize stand-by generators with associated power monitoring and transfer equipment, but this proposal has not met with a great deal of success, primarily because it is not possible to transfer power rapidly enough from the principal source to the stand-by source to maintain the oven in operation. Another reason this proposal has not been used widely is the relatively high expense involved in connection with the stand-by equipment.

It also has been proposed to use capacitor banks to keep the main gas supply valves open for a few seconds following power failure or reduction, but during this time gas continues to flow into the oven without being burned. This proposal also has not been widely accepted because management of many bakeries considers the discharging of unburned gas into a hot oven to create an unsafe condition.

SUMMARY OF THE INVENTION

The principal object of the invention is to provide a method and apparatus for use with a gas or other flowable combustible fuel oven which is responsive to electrical energy failure or reduction to a level below a threshold value to effect instantaneous termination of the flow of fuel to the oven, but which enables a completely safe and substantially instantaneous relighting of the oven should the energy failure or reduction be of the transient kind which endures for a few seconds only.

Apparatus constructed in accordance with the invention may be retrofitted to existing gas-fired ovens and it also may be provided as original equipment. In either case the oven is provided with a substantially conventional fuel igniting system and procedure which must be adhered to in the initial start-up of the oven, as well as a substantially conventional fuel shut-off system that is responsive instantly to electrical power failure or brownout reduction below a threshold value to shut off the flow of fuel to the oven.

According to the invention, the conventional oven lighting system is modified to incorporate a reset mechanism which is operable to effect relighting of the oven if the electric energy is restored to at least a predetermined threshold level within a time period of not more than a few seconds. The reset mechanism is completely safe to use, even if the fuel is a combustible, flowable gas because the power failure or reduction results in instantaneous termination of the flow of fuel to the oven and does not permit resumption of fuel flow to the oven unless and until the entire oven control system is operating satisfactorily.

The reset mechanism is incorporated directly in the path of fuel which flows to the oven and is directly responsive to a reduction in fuel pressure to disable relighting of the oven following the passage of a predetermined, short time interval.

THE DRAWINGS

Apparatus constructed in accordance with the presently preferred embodiment of the invention is illustrated in the accompanying drawings wherein:

FIG. 2 is a schematic diagram of an electrical control circuit for controlling the flow of fuel from its supply to the burner;

THE PREFERRED EMBODIMENT

Figure 1:
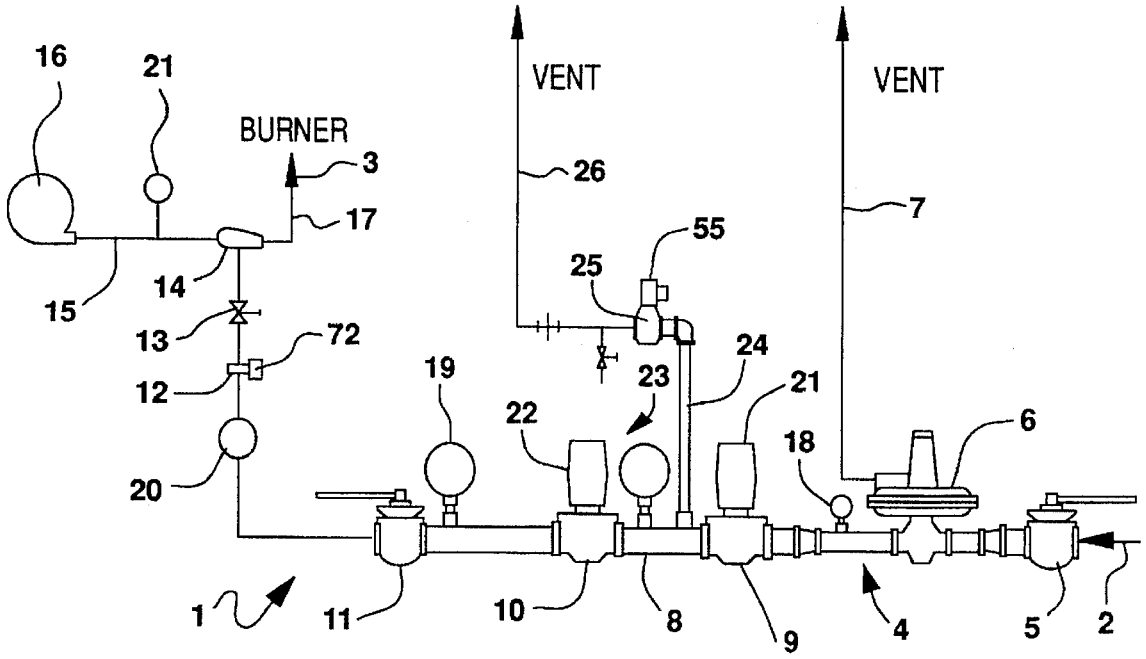
FIG. 1 is a schematic view of a gas fuel flow system from a supply to the fuel burner of an oven.

Apparatus constructed in accordance with the preferred embodiment of the invention is adapted for use in conjunction with a combustible fuel train 1 for delivering pressurized fuel, such as LP or natural gas, from a source 2 to a conventional fuel burner 3. The fuel train comprises piping 4 coupled at one end to the source 2 via a gas cock 5, a conventional gas regulator 6 having its own vent line 7, a conduit section 8 connected at its opposite ends to industrial gas valves 9 and 10 of conventional construction, such as those manufactured by Honeywell, Inc., under Model Nos. V4055 and V5055-A-E.

The fuel piping extends from the valve 10 through another cock 11 to a solenoid controlled burner shut-off valve 12 of conventional construction and thence through a variable orifice cock 13 to a venturi mixer 14, within which fuel is mixed with combustion air delivered to the mixer via a line 15 and a combustion fan or blower 16. The mixture of fuel and combustion air is delivered from the mixer 14 via a line 17 to the burner 3. Suitable gauges and other devices are incorporated in the piping 4 and the air line 15 as is conventional. Typically, these devices include a pressure gauge 18, a high fuel pressure manual reset 19, a zero regulator 20, and an air pressure switch 21.

The valve 9 is movable between opened and closed conditions in response to energization and deenergization of a solenoid 21. The open/closed condition of the valve 10 is controlled by a similar solenoid 22 as will be explained in more detail hereinafter. Energization of the solenoid 21 opens the valve 9, energization of the solenoid 22 opens the valve 10, and deenergization of the solenoids 21, 22 closes the respective valves 9 and 10.

In communication with the conduit section 8 between the valves 9 and 10 is a reset switch assembly 23, shown both in FIG. 1 and in line 8 of FIG. 2. (The horizontal lines in FIG. 2 are numbered to facilitate the description.) Also in communication with the conduit 8 between the valves 9 and 10 is a vent pipe 24 in which is located a solenoid controlled vent valve 25 and from which extends a vent extension line 26.

When the apparatus shown in FIG. 1 is conditioned for operation, as will be explained in more detail hereinafter, the valves 9, 10, and 12 will be open so that gas may flow from the source 2 through the piping 4 into the mixer 14 in which it is mixed with combustion air and delivered through the piping 17 to a burner 3. During the flow of gas to the burner 3 the vent valve 25 is closed.

Whenever the valves 9 and 10 close, the flow of gas to the burner 3 is terminated instantly. Simultaneously with the closing the valves 9 and 10 the vent valve 25 is opened. Gas which is trapped in the conduit 8 between the valves 9 and 10 is enabled to escape therefrom via the vent pipe 24, the vent valve 25, and the vent line 26.

The reset assembly 23 is a pressure sensitive switch mechanism of the kind manufactured and sold by Honeywell, Inc., under Model No. C437D-H,J,K; C637B, and includes a housing within which is a switch 27 (FIG. 2, line 8) the condition of which is controlled by a diaphragm 28 shown schematically in FIG. 2. The diaphragm is movable or displaceable in response to variations in pressure. In the diaphragm as supplied by the manufacturer is an orifice which enables slow leakage of gas through the diaphragm into the vent pipe 24. When the fuel pressure in the conduit 8 is reduced, via the orifice, to a predetermined level, the diaphragm will be displaced an amount sufficient to open the switch 27. The rate at which gas flows through the orifice, and consequently, the time required to effect movement of the switch from its closed condition to its opened condition, depends upon the size of the orifice. Orifices of virtually any desired size may be obtained from the manufacturer.

Figure 4:
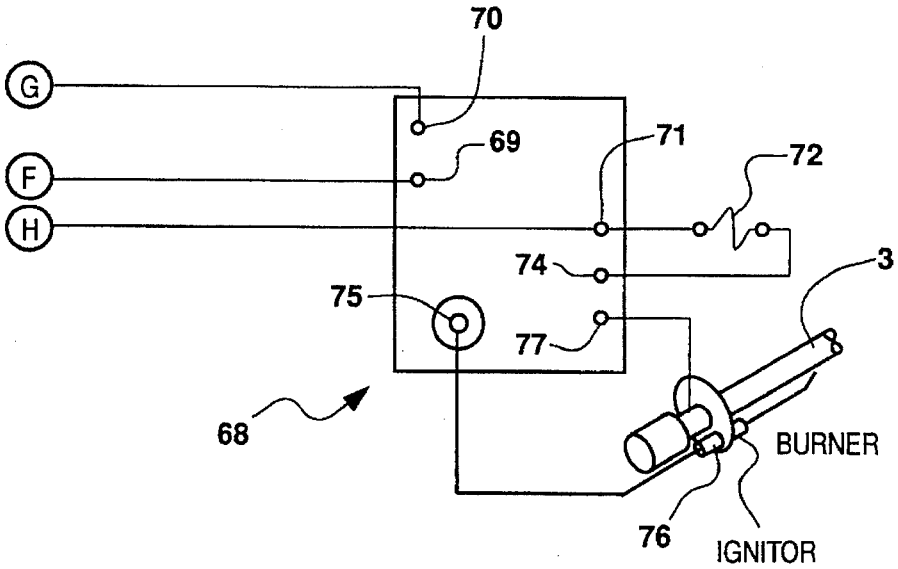
FIG. 4 is a schematic diagram of burner igniting apparatus.

The apparatus thus far described functions in a manner which will be explained in detail in the description of the circuitry shown in FIGS. 2–4, but for the present it should be understood that, whenever the solenoids 21 and 22 close the gas valves 9 and 10, the vent valve 25 opens, and vice versa.

FIG. 2 discloses a gas train main electric circuit 30 installed on a panel associated with an oven (not shown) and connected to a source 31 of three-phase electric power of suitable energy level by means of a main switch 32 and a transformer 33, as is conventional. Branching off the input lines between the main switch 32 and the transformer 33 are connectors A, B, and C (FIGS. 2 and 3) leading to an exhaust fan motor M1 through normally open contacts $M_1$ and suitable fuses (not shown).

The circuit 30 extends from the transformer 33 and has two power lines L1 and L2. A fan motor control relay MR (line 1) is connected in the circuit 30 between power lines L1 and L2 via a manually operable on/off switch 34. Closing the switch 34 enables the relay MR to be energized, thereby closing the normally open contacts $M_1$ and starting the exhaust fan motor M-1.

Connected to the power line L1 (as shown in line 2) are a manually operable on/off switch 35 which is connected to another normally open contact $M_2$ of the relay MR, a pressure switch 36 in the circuit of the exhaust fan motor M-1, an oven high temperature cut-out switch 37, and a manually resettable high gas pressure switch 38. As will be explained subsequently, the relay MR and the contact $M_2$ function to disconnect the gas valves 9 and 10 from the circuit in response to energy reduction. From the high pressure gas switch 38 extends a conductor having sections 39 (line 3) and 40 coupled to one terminal of a normally open interlock contact $PR_1$ (line 4) and thence to an automatically resettable timer clutch relay TC which is energized in response to closing of the normally open contact $PR_1$ in a manner subsequently to be explained.

The conductor 40 is connected (as shown in line 5) to a terminal 42 of a purge timer switch assembly 43. The terminal 42 is connected to a purge timer motor relay TM through a normally closed purge timer contact 44*a* that opens in response to energization of the timer clutch relay TC, and a damper limit switch 45 which closes in response to closing of a damper (not shown) on the oven. In this circuit (line 5) is an auxiliary switch 46 associated with the gas valve 10 which may be manually closed to serve as the proof of closure switch. An indicator P1 (line 6) is in circuit with the purge timer motor relay TM to indicate when the latter is operating. The purge timer motor commences to operate upon energization of the purge timer clutch relay TC and the closing of the switches 45 and 46.

The purge timer switch assembly 43 also includes a normally open contact 44*b* (line 7) operated by the purge timer motor relay TM. The contact 44*b* is connected to one terminal of a manually operable on/off combustion blower switch 48 (line 7) and thence through another contact $M_3$ of the exhaust fan relay MR to the power line L2.

The conductor section 40 is connected to the terminal 42 of the low gas pressure automatic reset switch 23, a pressure responsive combustion blower switch assembly 50, a relay contact 51 which closes in response to energization of the combustion blower motor relay M-3, a fuel "on" indicator FO, and thence to the power line L2. A conductor 52 (extending vertically between lines 7 and 8) connects the automatic reset switch assembly 23 in parallel with the purge timer switch assembly 43, which is an important characteristic of the construction.

Connected in parallel with the fuel "on" indicator FO is the solenoid 21 which controls the main gas valve 9, the solenoid 22 which controls the gas valve 10, and a solenoid 55 which controls the vent valve 25. These solenoids are shown in lines 9, 10, and 11, respectively.

The pressure responsive combustion blower switch 50 (line 8) is a two-position switch. In one position it is connected to an indicator P2 (line 12) which indicates that the purging operation is over and in the other position it is connected to the solenoids 21, 22, 55 via the combustion blower relay contact 51.

Extending from the circuit controlled by the burner on/off switch 35 (line 2) is a conductor 56 which is connected through an auxiliary switch 57 (line 13) of the solenoid 21 and a normally closed contact $SR_1$, (line 14) to an audible alarm AA. A manually operable alarm silence switch 58 (line 15) may be closed to silence the alarm AA and simultaneously energize a relay SR (line 16) which then opens the contact $SR_1$ (silencing the alarm) and closes a second contact $SR_2$ (line 16) of the relay SR. The purge timer then commences to operate and permits oven purging for a predetermined period of time, usually four to five minutes.

Figure 3:
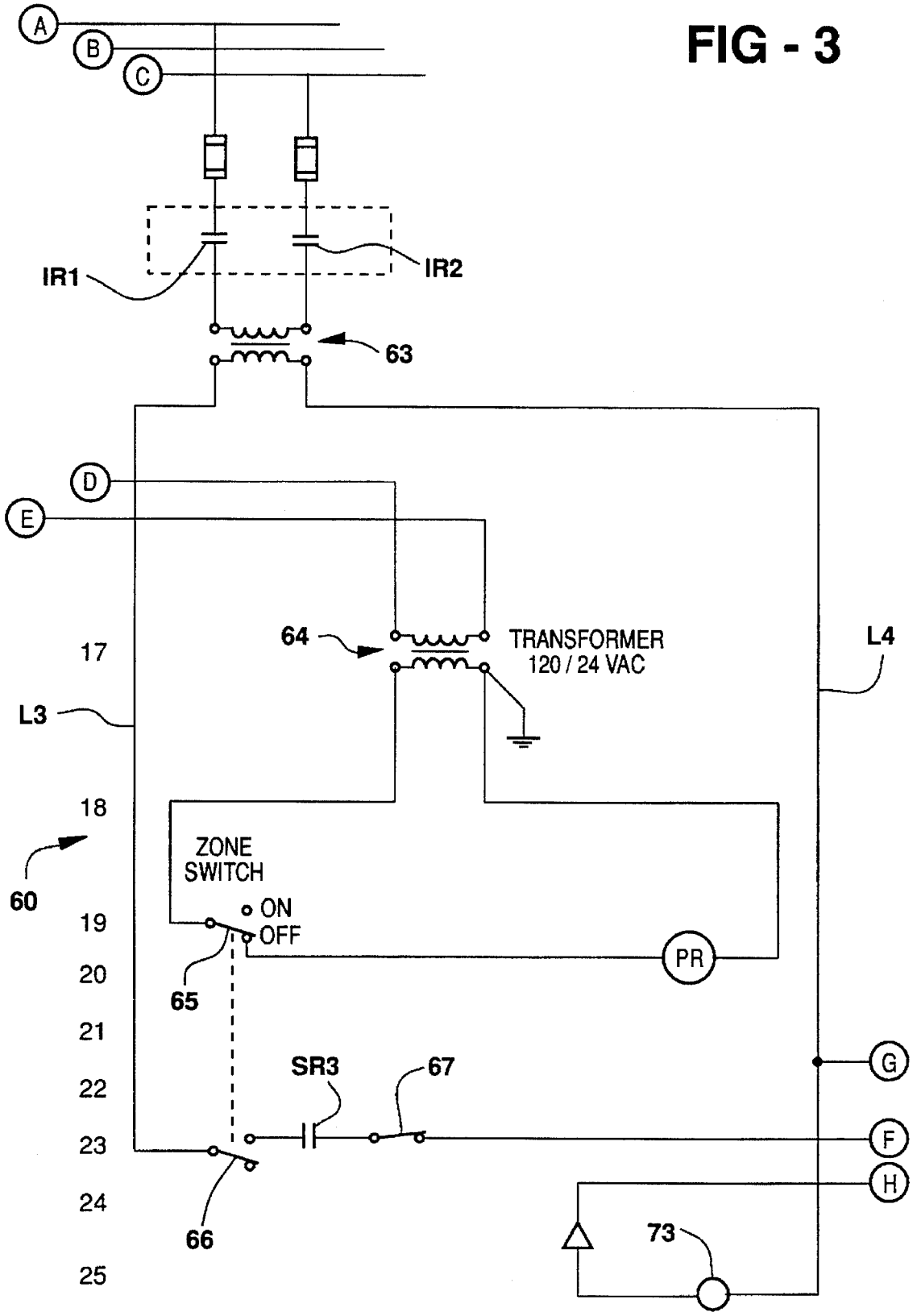
FIG. 3 is a schematic diagram of an electrical circuit forming an additional part of the control circuit.

FIG. 3 illustrates a panel 60 which is connected to the electric energy source 31 via connectors A, B, and C (also shown in FIG. 2), the contacts $IR_1$ and $IR_2$ of an ignition relay IR (line 13 of FIG. 2), and a transformer 63. From the transformer 63 extend power lines L3 and L4 which enter the panel 60.

Connected to the power lines L1 and L2 via connectors D and E (also shown in FIG. 2) is a transformer 64 (line 17 of FIG. 3) which also is connected to a manually operable switch 65 (line 19) which, in its off position, is connected to a purge interlock relay PR which controls the interlock contact $PR_1$ (line 4 of FIG. 2).

The switch 65 is ganged to a switch 66 (line 24). Closing of the contacts $IR_1$ and $IR_2$ makes it possible to actuate the burner 3 (FIG. 4) via a burner switch 67 (line 23 of FIG. 3) and a contact $SR_2$ (line 22 of FIG. 3) of the relay SR (line 16 of FIG. 2).

Since the relighting of the oven burner is to be accomplished automatically it is necessary that an automatically operable gas ignition be provided. A suitable ignition system is one manufactured by Joseph M. Day Company, Saginaw, Mich., and shown in FIG. 4. The ignition system includes what is known as an ignition sensor programmer printed circuit module 68 having one terminal 69 connected to the power line L3 via the connectors F (FIGS. 3 and 4), the switches 66 and 67, and a contact $SR_3$ of the relay SR. The circuit is completed through the module by a second contact 70 connected via connectors G to the power line L4. Another contact 71 connects the operating solenoid 72 of the gas valve 12 to the power line L4 via the connectors H and a burner "on" signal lamp 73. The circuit to the solenoid 72 is completed via a ground contact 74.

A terminal 75 fixed on the panel 68 connects a spark igniter and flame sensor 76 of known construction to the burner 3. The igniter circuit is connected to a ground terminal 77 on the panel 64.

The initial start-up procedure is substantially conventional; the principal advantageous characteristics of the invention reside in the ability of an oven burner to be relighted within a very limited time period following shutdown of operation of the oven burner in response to the interruption or reduction of the electric energy source which, when at a sufficiently high level, enables the flow of fuel to the burner. To facilitate understanding of the relighting procedure, the initial start-up procedure also will be described.

To initiate the flow of fuel to and combustion in an oven the main switch 32 is closed to connect the circuit 30 to a source of electric energy having a requisite normal value, thus energizing the transformers 33 and 64. The switch 34 (line 1) then may be closed to energize the exhaust fan relay MR, thereby closing the contact $M_2$ (line 2) and starting the exhaust fan. As the exhaust fan operates air pressure rises, thereby closing the pressure switch 36 (line 2). The switches 37 and 38 remain closed.

The zone switch 65 (line 1 of FIG. 3) is in its off position, thereby energizing the purge relay PR and closing the interlock contact $PR_1$ (line 4) and effecting energization of the purge timer clutch relay TC. A purge damper (not shown) on the oven (not shown) is opened, thereby closing damper switch 45 (line 5). Auxiliary gas valve switch 46 then is closed to provide proof of closure and energize the purge motor timer relay TM (line 5) and start the purge motor. At the same time, the signal P1 (line 6) will be activated to indicate that the purge procedure is under way. After a period of time, usually 4 to 5 minutes, the purge motor stops as a result of timing out of the purge timer 43.

After the purging is completed, the contact **44*a* of the purge timer switch 43 opens, the purge motor TM deenergizes, and the purge "on" indicator P1 deactivates. At the same time, the purge timer switch contact 44*b* (line 7) closes and the purge over signal P2 (line 12**) energizes.

The combustion air blower switch 48 (line 7) is closed manually thereby energizing the combustion air blower relay M-3 to start the combustion air blower 16. Operation of blower 16 causes combustion air pressure to rise, thereby closing the pressure responsive combustion blower switch 50 (line 8). At the same time that the combustion blower relay M-3 is energized, contact 51 (line 8) is closed so that, when the combustion air pressure responsive switch assembly 50 closes, the fuel "on" signal FO will be activated and each of the solenoids 21, 22, and 55 will be actuated.

Actuation of the solenoid 21 effects opening of the gas valve 9, actuation of the solenoid 22 effects opening of the gas valve 10, and actuation of the solenoid 55 closes the normally open vent valve 25.

At the same time, the auxiliary gas valve switch 57 (line 13) changes its position to energize an ignition relay IR, thereby closing the relay contacts $IR_1$ and $IR_2$ (FIG. 3) enabling the transformer 63 to be energized. Fuel then is enabled to flow from the supply 2 to the mixer 14 and to the burner 3.

Energization of the transformer 63 enables the solenoid operated gas valve 12 (FIG. 1) to open and fuel to flow from the supply through the mixer 14 to the burner 3. Simultaneously, the igniter 76 is energized to create a series of sparks to ignite the mixture of gas and air issuing from the burner. Once the burner is ignited, the flame is sensed and the operation of the igniter is terminated, as is conventional.

As fuel flows through the piping from the supply 2 to the burner, pressure of the fuel upstream from the valve 12 and the variable orifice gas cock 13 may be maintained at the desired level to provide positive pressure in the conduit section 8 between the valves 9 and 10. The positive pressure will cause the reset assembly 23 to close the reset switch 27 (line 8). As is shown clearly in FIG. 2, the reset assembly 23 is in parallel with the purge timer switch contacts **44*a* and 44*b***. The significance of this will be explained.

During operation of the oven the energy level of the power source 31 ideally remains substantially constant. However, it is not uncommon for variations in the energy level to be encountered due to any number of reasons, such as thunderstorms, power transmission breakdowns, transformer problems, power overloads, and the like. These events can cause either a temporary or longer-term interruption of the supply of energy or a reduction in the energy to a level below the threshold value needed to power the oven control circuit.

The construction of the apparatus disclosed herein is such that, whenever power is interrupted or reduced to a level below the necessary threshold level, the delivery of gas to the burner 3 is terminated instantly. However, if the power interruption or reduction is short lived, the oven may be relighted without the time consuming procedures associated with the initial lighting, and without encountering any unsafe conditions.

When the oven system is in operation and a power interruption or reduction occurs that is sufficient to reduce the electric energy level to one that is lower than a predetermined threshold, the exhaust fan relay MR (line 1) is deenergized, thereby opening the contact $M_2$ (line 2) and deenergizing the combustion blower relay M-3 and the purge timer motor relay TM. The relay MR thus functions to monitor the energy source and disconnect the circuit 30 from the solenoids 21, 22, and 55 which control the gas and vent valves when the energy level is reduced to a predetermined threshold level. Deenergization of the purge timer motor relay closes the contact 44*a* and opens the contact 44*b*. Deenergization of the combustion blower relay M-3 opens the contact 51 (line 8) thereby instantly deenergizing the solenoids 21, 22, 55, as a consequence of which the valves 9 and 10 close and the vent valve 25 opens. At this time the gas in the conduit section 8 is trapped in the zone between the valves 9 and 10 and the gas pressure in the conduit section initially is at least sufficient to maintain the switch 27 of the reset assembly 23 closed. However, the gas pressure gradually decays due to leakage of the gas through the orifice in the diaphragm.

If the cause of the electric energy interruption or reduction is overcome rather quickly, the exhaust fan relay MR will be reenergized, thereby closing the contact $M_2$ (line 2) enabling reenergization of the combustion blower relay M-3 through the reset assembly 23, the conductor 52, and the manually operable combustion blower on/off switch 48 (line 7). The combustion blower motor then will restart. The interruption in energy to the combustion blower 16 will not effect immediate elimination of the combustion air pressure acting on the switch assembly 50 (line 8) inasmuch as the rotor of the blower will require a little time in which to spool down. However, if the combustion air pressure does lower to the point where the switch 50 opens, reenergization of the combustion air blower will increase the air pressure and cause such switch 50 to re-close. Once the switch 50 re-closes the solenoids 21, 22, and 55 will be reenergized, thereby opening the valves 9 and 10 and closing the vent valve 25.

The size of the orifice in the diaphragm of the reset assembly 23 is chosen so that a time interval of between about 5 and 8 seconds is required to elapse before the switch 27 (line 8) opens. This normally is a sufficient period of time to enable transitory energy interruptions and brownouts to be corrected. It is possible, of course, to provide for shorter or longer time intervals before the switch 27 open, but the time interval referred to usually is adequate.

The disclosed embodiment is representative of a presently preferred form of the invention, but is intended to be illustrative rather than definitive thereof. The invention is defined in the claims.

I claim:

1. Apparatus for controlling the delivery of a flowable, combustible fuel from a pressurized supply thereof to a fuel burner, said apparatus comprising fuel delivery means extending from said supply to said burner; valve means in said delivery means movable between opened and closed conditions respectively to enable and disable fuel flow from said supply to said burner; electric circuit means; main switch means for coupling and uncoupling said circuit means to a source of electric energy having a normal value, said circuit means including a plurality of components operable in predetermined sequence to connect said valve means to said energy source and move said valve means from said closed condition to said opened condition; disconnect means in said circuit means operable in response to a reduction from said normal value of said energy source to a lower threshold value to disconnect said valve means from said energy source and move said valve means to said closed condition; reset means in said circuit means operable in response to restoration of the level of said energy at least to said threshold value to effect return movement of said valve means from said closed condition to said opened condition; and timing means in circuit with said reset means for disabling said reset means from effecting said return movement of said valve means following the passage of a predetermined interval of time from said reduction of said energy level of said energy source.

2. Apparatus according to claim 1 wherein said valve means comprises first and second valves in said fuel delivery means spaced apart to form a zone therebetween.

3. Apparatus according to claim 2 including a vent in communication with said delivery means at said zone for venting fuel from said zone.

4. Apparatus according to claim 3 including vent valve means in said vent and operating means coupled to said vent valve means for opening and closing the latter.

5. Apparatus according to claim 4 wherein the operating means for said vent valve means is in circuit with said disconnect means and operable to open said vent valve means in response to disconnection of said first and second valves from said energy source.

6. Apparatus according to claim 4 wherein the operating means for said vent valve means is in circuit with said disconnect means and operable to close said vent valve means in response to reconnection of said first and second valves to said energy source.

7. Apparatus for controlling the delivery of flowable fuel from a pressurized supply thereof to a fuel burner; said apparatus comprising a conduit extending from said supply to said burner; first and second valves in said conduit movable between closed and opened conditions for disabling and enabling respectively fuel flow from said supply to said burner; electrical circuit means; means for coupling and uncoupling said circuit means to a source of energy having a normal value, said circuit means including a plurality of components operable in sequence following coupling of said circuit means to said energy source to effect movement of said first and second valves to said opened condition, one of said components being operable in response to a reduction in the normal level of said energy to less than a threshold level to disconnect said energy source from said first and second valves and effect movement thereof from said opened condition to said closed condition; reset switch means in circuit with said one component for reconnecting said first and second valves to said energy source in response to restoration thereof at least to said threshold value; and timing means acting on said reset switch means for disabling operation thereof following the passage of a predetermined interval of time after the said reduction in the normal level of said energy.

8. The apparatus according to claim 7 wherein said timing means comprises a housing in communication with said conduit and within which is a movable actuator responsive to variation in fuel pressure in said conduit to operate said reset switch means.

9. The apparatus according to claim 8 wherein said timing means includes a diaphragm in said housing displaceable in response to variations in fuel pressure in said conduit, and a fuel passage through said diaphragm for venting fuel from said conduit.

10. The apparatus according to claim 9 including valve means for enabling and disabling venting of fuel from said conduit.

11. Apparatus for controlling the delivery of flowable fuel from a pressurized supply thereof to a fuel burner; said apparatus comprising a conduit extending from said supply to said burner; first and second valves in said conduit movable between closed and opened conditions in which said fuel respectively is disabled and enabled to flow from said supply to said burner; electrical circuit means; means for coupling and uncoupling said circuit means to a source of electric energy having a normal value, said circuit means including a plurality of components operable in sequence following coupling of said circuit means to said energy source to effect movement of said first and second valves to said opened condition, one of said components being operable in response to a reduction in the normal value of said energy to less than a threshold level to disconnect said energy source from said first and second valves and effect movement thereof from said opened condition to said closed condition; reset switch means in circuit with said one component for reconnecting said first and second valves to said energy source in response to restoration thereof to at least said threshold value; and timing means acting on said reset switch means for disabling operating thereof following the passage of a predetermined interval of time after the reduction in the normal value of said energy.

12. The apparatus according to claim 11 wherein said timing means comprises a housing in communication with said conduit and within which is a movable actuator responsive to variations in fuel pressure in said conduit to operate said reset switch means.

13. The apparatus according to claim 12 wherein said timing means comprises a diaphragm displaceable in response to variations in fuel pressure in said conduit, and a fuel passage in said diaphragm for venting fuel in said conduit.

14. The apparatus according to claim 9 including vent valve means for enabling and disabling fuel in said conduit to be vented, and means for moving said vent valve means to positions in which venting of fuel from said conduit is enabled and disabled.

15. The apparatus according to claim 14 including means interconnecting said vent valve means and said one of said components for effecting movement of said vent valve means in timed relation to the movements of said first and second valves.

16. The apparatus according to claim 15 wherein the interconnecting means is operable to effect movement of said vent valve means to a position enabling venting of said fuel when said valve means is moved to said closed condition and vice-versa.

17. Apparatus for temporarily or permanently terminating the flow of combustible, flowable fuel from a supply thereof to a fuel burner, said apparatus comprising fuel delivery means for delivering fuel from said supply to said burner; a source of electric energy having a normal value; an electric circuit; means for coupling said circuit to said energy source; fuel valve means in said delivery means for selectively enabling and disabling fuel flow to said burner; electrical valve control means in said circuit operable to move said fuel valve means to a first position enabling fuel flow to said burner; disconnect means in said circuit operable in response to a reduction in the value of said energy source to a level less than a predetermined threshold level to disconnect said valve control means from said energy source and effect movement of said fuel valve means to a second position disabling fuel flow to said burner; reset means in said circuit operable to reconnect said fuel valve control means to said energy source; and timing means acting on said reset means for preventing said reset means from reconnecting said fuel valve control means to said energy source following the passage of a predetermined time interval commencing with the disconnection of said fuel valve control means from said circuit.

18. The apparatus according to claim 17 wherein said time interval is between about 5 and 8 seconds.

19. The apparatus according to claim 17 wherein said fuel valve means comprises first and second valves spaced apart to form therebetween a zone in said delivery means; a vent in communication with said zone, vent valve means in said zone for enabling and disabling venting of said zone; and vent valve operating means in circuit with said fuel valve control means and operable in response to movement of said fuel valves from said first position to said second position to effect movement of said vent valve to a position in which said vent valve enables venting of said zone and vice versa.

20. A method of interrupting the flow of a flowable combustible fuel from a supply thereof to a fuel burner comprising establishing pressurized fuel flow from said supply to said burner; monitoring the level of electrical energy from a source thereof; terminating the flow of said fuel to said burner in response to a reduction in the energy level of said source to a level less than a predetermined threshold; timing a period of time commencing with the termination of said flow; and reestablishing the flow of said fuel to said burner only if the energy level of said source rises to said predetermined threshold within a predetermined time interval following the termination of said flow.

21. The method according to claim 20 including slowly reducing the pressure of said fuel, and enabling reestablishing of the flow of said fuel to said burner within said predetermined time interval only as long as the pressure of said fuel is at or above a minimum level.

22. The method according to claim 21 including reducing the pressure of said fuel by trapping some of said fuel in a zone, and venting said zone.

23. The method according to claim 22 including discontinuing venting said zone simultaneously with reestablishing fuel flow to said burner.

* * * * *